US005326421A

United States Patent [19]

Taylor

[11] Patent Number: 5,326,421

[45] Date of Patent: Jul. 5, 1994

[54] TAPE DISPENSERS

[76] Inventor: Gerald M. Taylor, 50 Townsend Lane, Harpenden, Hertfordshire Al5 2QS, England

[21] Appl. No.: 862,586

[22] PCT Filed: Nov. 4, 1991

[86] PCT No.: PCT/GB91/01924

§ 371 Date: Jun. 26, 1992

§ 102(e) Date: Jun. 26, 1992

[87] PCT Pub. No.: WO92/07785

PCT Pub. Date: May 14, 1992

[30] Foreign Application Priority Data

Nov. 2, 1990 [GB] United Kingdom ..... 9023809

[51] Int. Cl.[5] ..... B32B 31/00

[52] U.S. Cl. ..... 156/526; 156/530; 156/577; 156/579

[58] Field of Search ..... 156/523, 526, 530, 574, 156/577, 579, 518, 525, 528, 531, 532, 533, 534

[56] References Cited

U.S. PATENT DOCUMENTS 3,523,053 8/1970 Zbinden et al. ..... 156/523
4,238,271 12/1980 Urushizaki ..... 156/523
4,345,966 8/1982 Iiyama et al. ..... 156/523
4,379,019 4/1983 Pool ..... 156/554 X
4,486,263 12/1984 Monzo Gomez ..... 156/523

*Primary Examiner*—David A. Simmons
*Assistant Examiner*—James J. Engel, Jr.
*Attorney, Agent, or Firm*—Seidel, Gonda, Lavorgna & Monaco

[57] ABSTRACT

A tape dispenser for adhesive tape (36) comprises a housing, carriage means (22) within the housing for mounting a reel (37) of tape (36), an aperture (51) in the housing through which the tape is arranged to be dispensed on to a surface, applicator rollers (27, 25) within the housing movable to apply the tape to said surface, and a cutter blade (46) within the housing to sever the tape. The cutter blade (46) is retracted when the applicator rollers (27, 25) apply the tape to said surface. At the completion of the applicator the applicator rollers (27, 25) in their withdrawal cause the tape (36) to be presented under tension to the cutter blade to be severed thereby. A push-button (31) controls operation of the dispenser. Depression of the push-button (31) causes the whole carriage (22) inclusive of the tape reel (37) to be displaced towards the application surface.

14 Claims, 4 Drawing Sheets

TAPE DISPENSERS

This invention relates to dispensers for adhesive tape.

Various types of dispenser are known for removing lengths of tape from a reel of adhesive tape. Many dispensers hold the tape reel securely whilst the tape is drawn out to a required length. The tape is then pressed against a toothed cutting edge to sever it from the reel. The length of tape is then applied to a surface by hand. In other tape dispensers a cutting mechanism comprising a blade is used to sever the tape. However, this can result in a degraded performance with the passage of time and can cause problems with varying tension in the wound tape.

Adhesive tapes have a wide variety of properties, both in terms of the nature of the adhesive and in terms of the tension with which the tape is wound on the reel. It is an object of the present invention to create a tape dispenser which is suitable for all types of tape and reel, regardless of winding tension.

It is a further object to provide a tape dispenser in which the cutter mechanism is not a hazard to the user.

It is also an object of the invention to provide a dispenser which delivers adhesive tape to a surface and cuts the tape without the need for any manual contact with the tape. Preferably the dispenser can be operated with one hand.

In accordance with the invention there is provided a tape dispenser for adhesive tape, comprising a housing, carriage means within the housing for mounting a reel of tape, an aperture in the housing through which the tape is arranged to be dispensed on to a surface, applicator means within the housing movable to apply the tape to said surface, and cutter means within the housing to sever the tape, wherein the cutter means is retracted when the applicator means applies the tape to said surface, and wherein at the completion of the application the applicator means in its withdrawal causes the tape to be presented under tension to the cutter means to be severed thereby.

Preferably, withdrawal of the applicator means causes the dispensed tape to be partially lifted from the said surface so that the tape is stretched between guide means at the underside of the housing and an entraining device of the applicator means.

The cutter means preferably is arranged to move substantially parallel to the said surface to which the tape is applied.

Preferably, the carriage means which carries the tape reel is displaceable within the housing towards and away from the said surface to which the tape is applied.

The tape cutting means preferably comprises a blade with a serrated edge operating in conjunction with a tape delivery means of a roller which spreads the tape onto the surface over which the dispenser moves. The use of a serrated blade perforates the tape and then splits it, thus giving an improved performance.

One embodiment of tape dispenser in accordance with the invention will now be described by way of example and with reference to the accompanying drawings, in which.

Figure 1:
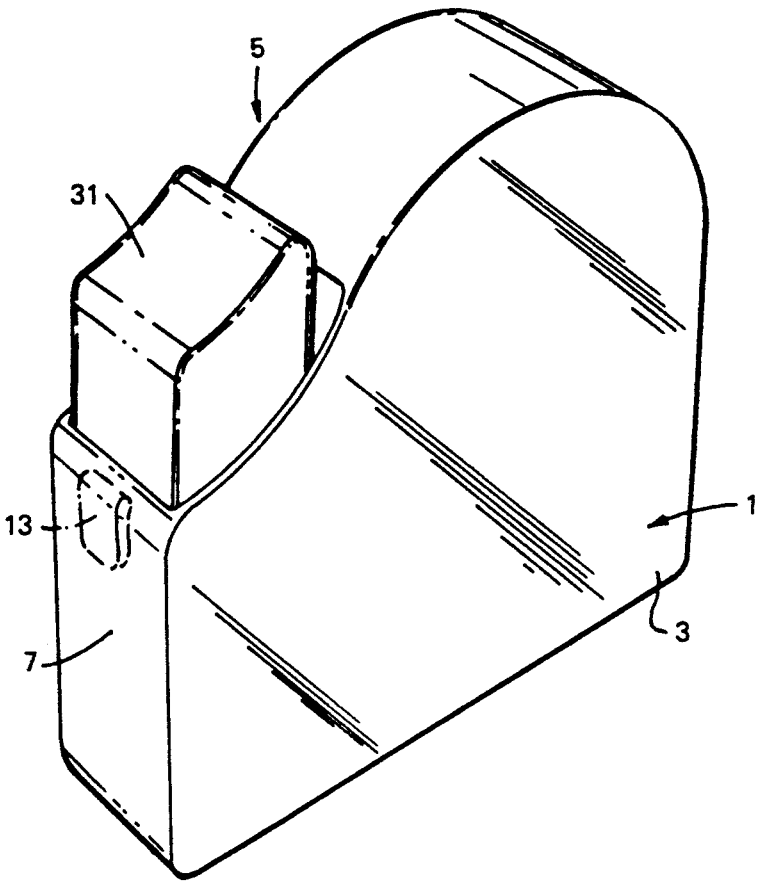
FIG. 1 is a general perspective view of the tape dispenser.
Figure 2:
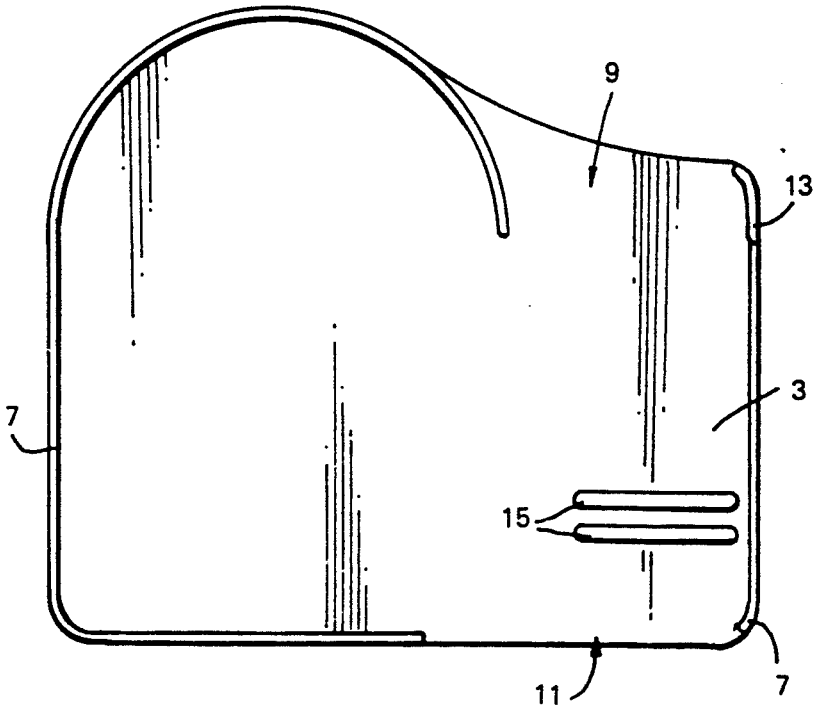
FIG. 2 is a side view of the inside of a removable cover part of the housing.

The tape dispenser comprises a two-part housing 1 moulded for example from a suitable plastics material. The two housing parts engage in nesting relationship. The one housing part, shown in FIG. 2, is a removable cover which has a side wall 3 and a peripheral wall 7 which defines the width of the housing. The peripheral wall 7 has a first aperture 9 at the upper front portion of the wall and a second aperture 11 at the forward end of the bottom of the wall. The rearward end of the bottom of the wall 7 defines the bottom face of the dispenser.

Fixed to the peripheral wall 7 is a protruding catch 13 by means of which the removable housing cover can be fitted detachably to the rest of the dispenser by elastic deformation. On the inside of the removable housing cover are a pair of parallel, horizontal guide ribs 15.

The other housing part has a side wall 5 provided with a peripheral wall 17 similar in construction to the peripheral wall 7. Wall 17 is positioned just inside wall 7 when the removable housing portion is fitted to the rest of the dispenser. The side wall 5 is provided with a pair of parallel, horizontal guide ribs 19 in opposing, aligned relationship with ribs 15. The side wall 5 is also provided with a groove 21 extending perpendicular to the bottom face of the dispenser.

A tape carriage indicated generally at 22 is constructed and mounted so that it can slide up and down within the housing 1 perpendicular to the bottom face of the housing. The carriage 22 comprises a one-piece plastics moulding having a base plate fitted with a fixed shaft 23, here of cruciform shape. The carriage also includes a web 24 which at its lower end carries a spindle for a tape applicator roller 27. Above and to one side of the roller 27 the base plate has a spindle for a freely rotatable guide roller 25. At the forward end of the dispenser the carriage has a downwardly extending curved tongue 29. The upper ends of the tongue 29 and web 24 merge to form a push-button 31 which projects through the aperture 9 in the housing. The push-button 31 when depressed causes the carriage 22 to slide downwards. Means are provided to guide the carriage 22 as it slides relative to the housing 1. A tongue which protrudes from the base plate of the carriage 22 is located in the groove 21. Also, the carriage 22 on each side of the shaft 23 has pairs of parallel guide flanges 30 which engage behind a corresponding pair of lugs 32 projecting from the interior surface of the wall 5.

Around the fixed shaft 23 is positioned a rotatable sleeve 35 constructed from material having a low coefficient of friction in order to facilitate rotation of a reel 37 of adhesive tape which is placed over the shaft 23 and sleeve 35. As shown, the tape 36 is taken from the reel 37, over the guide roller 25, past the applicator roller 27, and out through the bottom of the dispenser.

Figure 3:
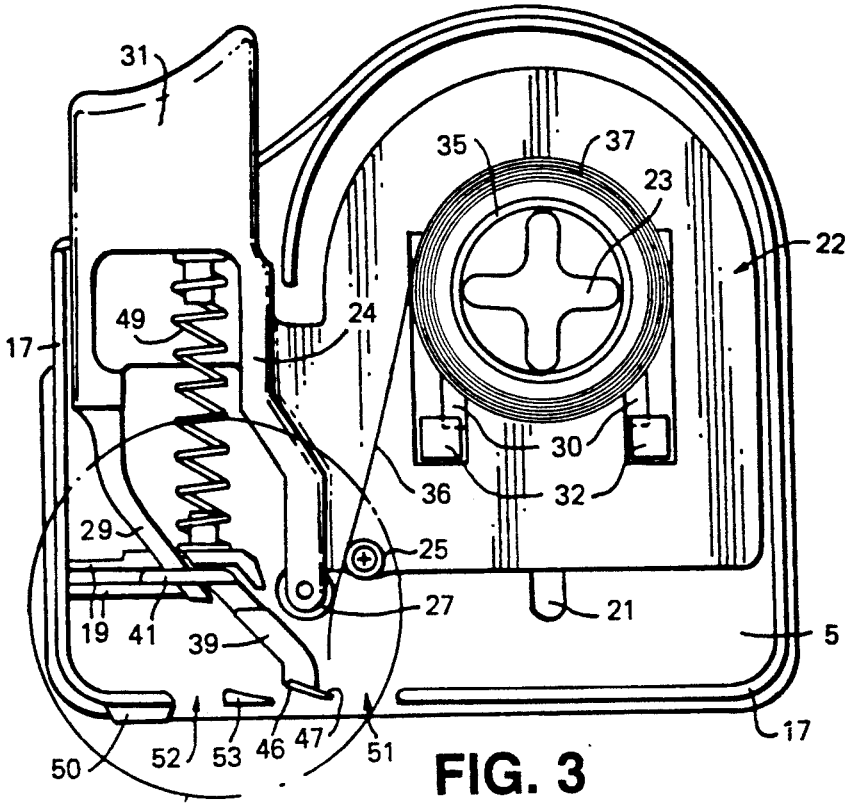
FIG. 3 is a side view of the interior of the tape dispenser showing the rest position of the tape delivery and cutting mechanism.
Figure 4:
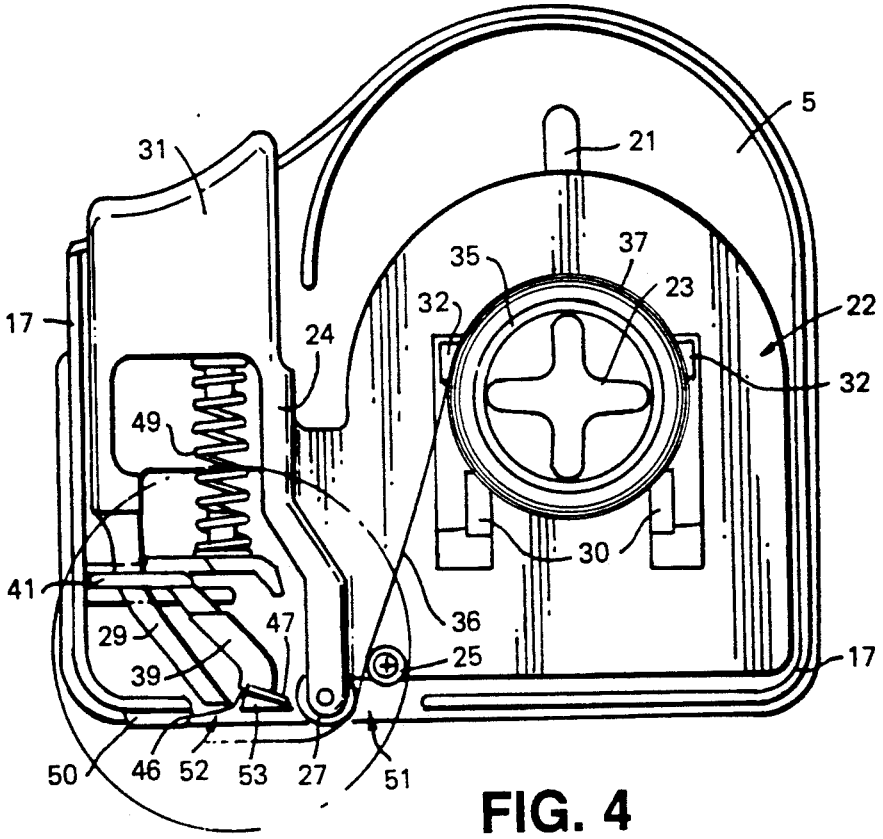
FIG. 4 is a view similar to FIG. 3 but showing the position of the tape delivery and cutting mechanism as the tape is applied to a surface.
Figure 5:
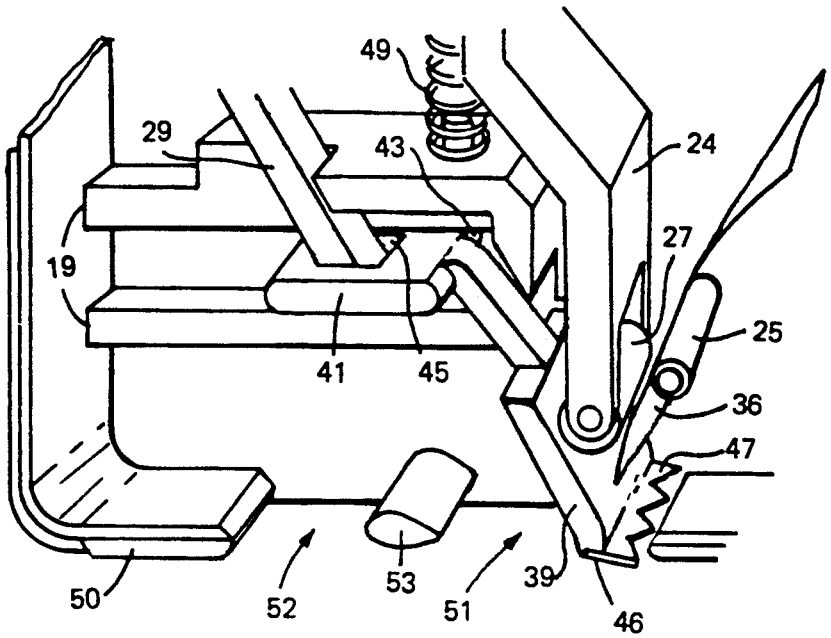
FIG. 5 is a perspective view of that part of FIG. 3 which is circled.
Figure 6:
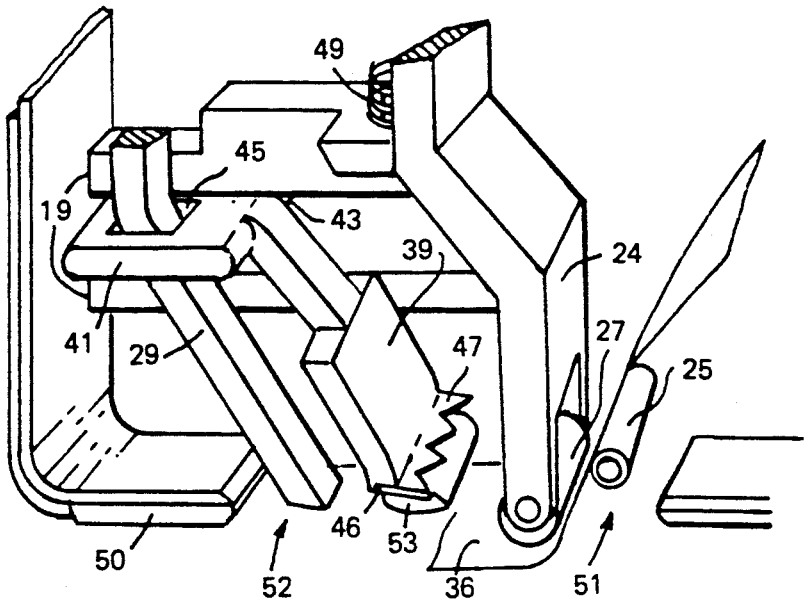
FIG. 6 is a perspective view of that part of FIG. 4 which is circled.

Also contained within the housing is a blade holder 39 which comprises two wings 41 and 43 which fit between the pairs of ribs 15 and 19 respectively, a slot 45 through which the curved tongue 29 can slide and means for attaching a blade 46 to that part of the blade holder 39 nearest the bottom peripheral wall of the dispenser. When the push-button 31 is depressed, the blade holder 39 will move, by a cam action, substantially parallel to the bottom of the dispenser and away from the tape 36, from the position shown in FIG. 3 to the position shown in FIG. 4, because of the cam action of the tongue 29 and the constraint of the guide ribs 15 and 19. On release of the push-button 31 a biassing spring 49 returns the carriage 22 to a rest position raised from the bottom of the dispenser, and the blade holder 39 moves back to the FIG. 3 position.

A smoothing pad 50 is provided on the underside of the dispenser, at the forward end, secured to the wall 17 of the housing. Rearwardly of this pad and spaced therefrom is a guide bar 53 which is integral with the housing side wall 5 and is upstanding therefrom. The bar 53 has a generally aerofoil cross-section.

Figure 7:
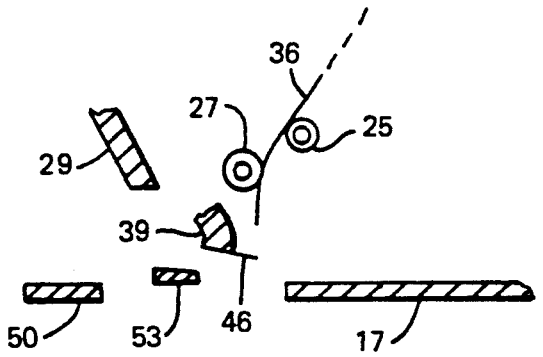
FIGS. 7, 8 and 9 are schematic diagrams illustrating the sequence of movements of the tape delivery and cutting mechanism.
Figure 8:
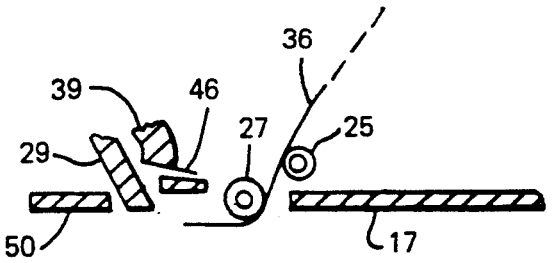
Figure 9:
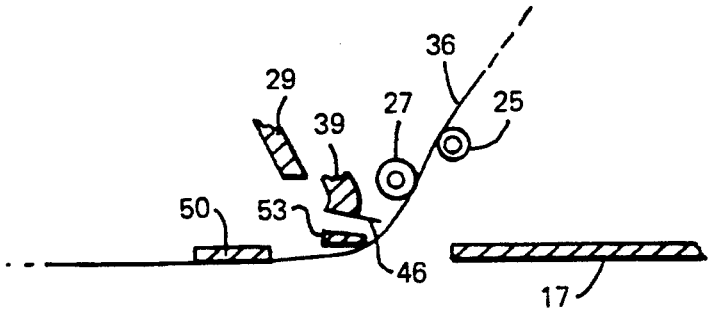

The manner of operation of the dispenser will now be described, with particular reference to the sequence diagrams of FIGS. 7 to 9. FIG. 7 shows the "at rest" position. In order to apply the adhesive tape 36 to a surface the operator depresses the push-button 31 towards the bottom of the dispenser (FIG. 8). This causes the blade holder 39 to be retracted and to move back horizontally across an aperture 51, in the manner described above. The blade 46 now lies above the guide bar 53. The bottom end of tongue 29 just protrudes through an aperture 52. The applicator roller 27 has passed down through the aperture 51 and pushes the free end of the tape 36, hanging down below the guide roller 25, onto the surface to which it is to be applied and spreading it out.

By drawing the dispenser along the surface, with the push-button 31 depressed, the desired length of tape is applied to the surface, the two rollers 25 and 27 serving as guides. The tape is smoothed by pad 50 and the end of tongue 29. When the push-button 31 is released (FIG. 9) the carriage 22 returns towards its rest position. The applicator roller 27 and guide roller 25 are raised and because of the adhesion between the tape 36 and the guide roller 25 the tape 36 is lifted up until it becomes taut between the rollers and the guide bar 53. Simultaneously, the blade holder 39 and blade 46 travel towards the tape 36, contacting the tape at an angle as shown in FIG. 9, preferably about 45°. The blade 46 has a serrated edge 47 which perforates the tape rather than cutting it. When the dispenser is removed from the surface the tape splits across these perforations to sever it. A blade with a serrated edge 47 which perforates is preferred to a single-edge blade which cuts and which would become clogged with adhesive on its cutting edge. It will be appreciated that the meeting of the blade and tape at an angle also assists in preventing accumulation of adhesive on the blade. It is an important feature of the invention that the tape is cut when it is under tension. Once cut, a "tail" of tape remains hanging from the guide roller 25 for the next application.

Initially the end of the tape 36 which is free from the reel 37 is stuck by the tape adhesive to the smaller guide roller 25 which is freely rotatable. However, the area of contact between tape 36 and the application surface will always be greater than the contact area between the tape 36 and guide roller 25. Therefore, once the tape 36 sticks onto the application surface the roller 25 is able to rotate, allowing the reel 37 to dispense the tape 36 as the dispenser is drawn along the surface. Thus, although roller 25 serves to hold and guide the tape, the ability to feed tape to a surface is independent of the adhesive strength of the tape.

The tape dispenser of the invention is an improvement over known dispensers. Tape can be dispensed on to a surface in a straight line-using only one hand without manual contact with the tape. The adhesive tape is used efficiently as there is no need repeatedly to find the free end of the tape on the tape reel. The dispenser can use tapes with a wide variety of adhesive strengths and is safe to use because any sharp cutting parts are completely enclosed within a housing.

I claim:

1. A tape dispenser for adhesive tape, comprising a housing, carriage means within the housing for mounting a reel of tape, an aperture in the housing through which the tape is arranged to be dispensed on to a surface, applicator means within the housing movable to apply the tape to said surface, cutter means within the housing to sever the tape, and a sliding cam mechanism to effect movement of the cutter means in coordination with movement of the applicator means, wherein the sliding cam mechanism includes a tongue which is part of the carriage means and is in sliding contact with the cutter means, wherein the cutter means is retracted when the applicator means applies the tape to said surface, and wherein at the completion of the application the applicator means in its withdrawal causes the tape to be presented under tension to the cutter means to be severed thereby.

2. A tape dispenser as claimed in claim 1, in which withdrawal of the applicator means causes the dispensed tape to be partially lifted from the said surface so that the tape is stretched between guide means at the underside of the housing and an entraining device of the applicator means.

3. A tape dispenser as claimed in claim 1, in which the tape is presented at an angle of the order of 45° to the cutter means.

4. A tape dispensers claimed in claim 1 in which the cutter means is arranged to move substantially parallel to the said surface to which the tape is applied.

5. A tape disperser as claimed in claim 1, in which the cutter means comprises a blade having a serrated edge.

6. A tape dispenser as claimed in claim 1, in which the carriage means which carries the tape reel is displaceable within the housing towards and away from the said surface to which the tape is applied.

7. A tape dispenser as claimed in claim 6, in which the carriage means is displaceable by push-button means and includes the applicator means as a part of the carriage.

8. A tape dispenser as claimed in claim 7, in which the push-button means includes a biassing spring.

9. A tape dispenser as claimed in claim 1, in which the applicator means comprises a first roller adapted to contact the non-adhesive side of the tape and to spread the tape on the said surface, and a second roller between the first roller and the tape reel and adapted to contact the adhesive side of the tape to perform a holding and guiding function.

10. A tape dispenser as claimed in claim 1, in which the tape reel is mounted on a sleeve which is freely rotatable on a support fixed to the carriage means.

11. A tape dispenser as claimed in claim 1, in which the cutter means comprises a blade and a blade carrier which are jointly removable from the housing, the blade carrier being a guided sliding fit within but not secured to the housing.

12. A tape dispenser as claimed in claim 1, in which the cutter means comprises a blade and a blade carrier, and the housing has fixed internal ribs constraining a plate-like portion of the blade carrier for sliding movement.

13. A tape dispenser for adhesive tape, comprising a housing, carriage means within the housing for mounting a reel of tape, an aperture in the housing through which the tape is arranged to be dispensed on to a surface, applicator means within the housing movable to apply the tape to said surface, cutter means within the housing to sever the tape, and a sliding cam mechanism to effect movement of the cutter means in coordination with movement of the applicator means, wherein the sliding cam mechanism includes a tongue which is part of the carriage means and is in sliding contact with the cutter means, the bottom end of the tongue projecting through said aperture and acting as a tape smoothing device in the dispensing position of the applicator means, wherein the cutter means is retracted when the applicator means applies the tape to said surface, and wherein at the completion of the application the applicator means in its withdrawal causes the tape to be presented under tension to the cutter means to be severed thereby.

14. A tape dispenser as claimed in claim 13, in which the cutter means comprises a blade and a blade carrier which are jointly removable from the housing, the blade carrier being a guided sliding fit within but not secured to the housing.

* * * * *